US009003681B2

(12) United States Patent
Simmons et al.

(10) Patent No.: US 9,003,681 B2
(45) Date of Patent: Apr. 14, 2015

(54) BUCKET TEETH HAVING A METALLURGICALLY BONDED COATING AND METHODS OF MAKING BUCKET TEETH

(75) Inventors: Jason M. Simmons, Platteville, WI (US); Donald R. Flatau, Sherwood Park (CA)

(73) Assignee: Deere & Company, Moline, IL (US)

( * ) Notice: Subject to any disclaimer, the term of this patent is extended or adjusted under 35 U.S.C. 154(b) by 2442 days.

(21) Appl. No.: 11/522,395

(22) Filed: Sep. 18, 2006

(65) Prior Publication Data

US 2008/0066351 A1 Mar. 20, 2008

(51) Int. Cl.
*E02F 9/28* (2006.01)
*E02F 3/00* (2006.01)

(52) U.S. Cl.
CPC ..... *E02F 9/285* (2013.01)

(58) Field of Classification Search
USPC ..... 37/453, 457, 460
See application file for complete search history.

(56) References Cited

U.S. PATENT DOCUMENTS

| | | | | | |
|---|---|---|---|---|---|
| 333,637 | A | * | 1/1886 | Kennedy | 37/339 |
| 673,423 | A | * | 5/1901 | Cupples | 37/452 |
| 711,992 | A | * | 10/1902 | Mason | 37/450 |
| 1,333,852 | A | * | 3/1920 | Kittredge | 37/450 |
| 1,336,576 | A | * | 4/1920 | Nichols | 29/891 |
| 1,427,610 | A | * | 8/1922 | McKee | 37/452 |
| 1,453,805 | A | * | 5/1923 | Nichols | 37/452 |
| 1,835,701 | A | * | 12/1931 | Edmunds | 37/460 |
| 1,963,525 | A | * | 6/1934 | Frank et al. | 420/12 |
| 2,033,594 | A | * | 3/1936 | Stoody | 172/713 |
| 2,271,172 | A | | 1/1942 | Heaslet | |
| 2,718,162 | A | * | 9/1955 | Smith | 76/104.1 |
| 2,931,094 | A | | 4/1960 | Teerlink | |
| 3,049,824 | A | * | 8/1962 | McIninch | 37/352 |
| 3,172,199 | A | * | 3/1965 | Schmidt | 29/421.2 |
| 3,310,870 | A | | 3/1967 | Parikh et al. | |
| RE27,851 | E | | 12/1973 | Alessi | |
| 3,805,423 | A | * | 4/1974 | Engel et al. | 37/453 |
| 3,888,637 | A | * | 6/1975 | Taguchi et al. | 428/583 |
| 4,011,051 | A | * | 3/1977 | Helton et al. | 75/244 |
| 4,042,282 | A | | 8/1977 | Haslett et al. | |
| 4,175,163 | A | | 11/1979 | Ikeno et al. | |
| 4,182,394 | A | | 1/1980 | Cason, Jr. | |
| 4,192,983 | A | * | 3/1980 | Paoletti | 219/76.1 |
| 4,207,123 | A | * | 6/1980 | Reynolds et al. | 148/113 |
| 4,224,382 | A | * | 9/1980 | Brown et al. | 428/656 |
| 4,625,810 | A | | 12/1986 | Edmisson | |

(Continued)

FOREIGN PATENT DOCUMENTS

| | | | |
|---|---|---|---|
| EP | 0 459 637 | A1 | 12/1991 |
| JP | 54-145335 | A | 11/1979 |

(Continued)

*Primary Examiner* — Abigail A Risic
(74) *Attorney, Agent, or Firm* — Buchanan Ingersoll & Rooney PC

(57) ABSTRACT

Bucket teeth having a metallurgically bonded wear-resistant coating and methods for forming the coated bucket teeth are disclosed. The bodies of the bucket teeth have a hard metal alloy slurry disposed on a surface and then are fused to form a metallurgical bond with the iron-based alloy. The wear-resistant coating can be formed of a fused, metal alloy comprising at least 60% iron, cobalt, nickel, or alloys thereof. The portion of the outer surface of the bucket teeth having the wear-resistant coating corresponds to a wear surface of the bucket teeth during operation.

22 Claims, 2 Drawing Sheets

(56) References Cited

U.S. PATENT DOCUMENTS

| | | | | | |
|---|---|---|---|---|---|
| 4,682,987 | A | | 7/1987 | Brady et al. | |
| 4,776,566 | A | | 10/1988 | Girdley | |
| 4,793,968 | A | | 12/1988 | Mosser et al. | |
| 4,851,267 | A | | 7/1989 | Miyauchi et al. | |
| 4,895,310 | A | | 1/1990 | Morris, Jr. | |
| 4,930,675 | A | | 6/1990 | Bedford et al. | |
| 4,954,058 | A | | 9/1990 | Revankar | |
| 5,018,283 | A | * | 5/1991 | Fellner | 37/452 |
| 5,027,878 | A | | 7/1991 | Revankar et al. | |
| 5,111,600 | A | * | 5/1992 | Lukavich et al. | 37/452 |
| 5,126,104 | A | | 6/1992 | Anand et al. | |
| 5,267,600 | A | | 12/1993 | Revankar | |
| 5,288,353 | A | | 2/1994 | Revankar | |
| 5,299,620 | A | | 4/1994 | Revankar et al. | |
| 5,337,801 | A | * | 8/1994 | Materkowski | 164/98 |
| 5,383,513 | A | | 1/1995 | Revankar | |
| 5,425,222 | A | | 6/1995 | Crain | |
| 5,443,916 | A | | 8/1995 | Revankar | |
| 5,456,323 | A | | 10/1995 | Hill | |
| 5,502,905 | A | * | 4/1996 | Cornelius et al. | 37/460 |
| 5,556,078 | A | | 9/1996 | Kubota et al. | |
| 5,789,038 | A | | 8/1998 | Ono | |
| 5,852,272 | A | * | 12/1998 | Amano | 219/76.14 |
| 5,879,743 | A | | 3/1999 | Revankar | |
| 5,881,480 | A | * | 3/1999 | Fall | 37/460 |
| 5,897,968 | A | | 4/1999 | Dosaka et al. | |
| 5,933,955 | A | | 8/1999 | Barnhart | |
| 6,045,200 | A | | 4/2000 | Anderton et al. | |
| 6,089,683 | A | | 7/2000 | Anderton et al. | |
| 6,145,941 | A | | 11/2000 | Anderton et al. | |
| 6,170,156 | B1 | * | 1/2001 | Lev et al. | 29/893.1 |
| 6,414,258 | B1 | | 7/2002 | Amano | |
| 6,430,851 | B1 | * | 8/2002 | Clendenning | 37/457 |
| 6,846,261 | B2 | | 1/2005 | Lev et al. | |
| 7,163,754 | B2 | * | 1/2007 | Revankar et al. | 428/679 |
| 2003/0168912 | A1 | | 9/2003 | Wodrich et al. | |
| 2005/0019558 | A1 | * | 1/2005 | Verma et al. | 428/336 |
| 2005/0064095 | A1 | * | 3/2005 | Revankar | 427/189 |
| 2006/0017323 | A1 | | 1/2006 | Wodrich et al. | |

FOREIGN PATENT DOCUMENTS

| | | | | | |
|---|---|---|---|---|---|
| JP | 60-089503 | | | 5/1985 | |
| JP | 60-089504 | | | 5/1985 | |
| JP | 07207713 | A | * | 8/1995 | E02F 9/28 |

* cited by examiner

BUCKET TEETH HAVING A METALLURGICALLY BONDED COATING AND METHODS OF MAKING BUCKET TEETH

BACKGROUND

Bucket teeth of buckets for excavators, diggers and other related excavation, digging, construction and mining equipment, are subjected to severe wear and corrosion conditions. Wear is caused by contact with abrasive materials including rocks, gravel and dry sand. The wear problem is further aggravated because such materials can be much harder than even hardened steel. The wear of bucket teeth is not substantially reduced by simply hardening the contact surface. Therefore, an approach other than heat treatment is desired to reduce the wear rate to prolong the life of bucket teeth substantially.

Also, due to the functional nature of such equipment, bucket teeth are frequently in intimate contact with wet materials, such as wet sand slurry, gravel and rocks. This contact can cause bucket teeth to corrode, thereby producing a synergistic effect on bucket tooth wear.

Accordingly, it is desirable to provide longer wearing surfaces on bucket teeth to extend the service life and to reduce the associated long-term maintenance cost.

SUMMARY

An exemplary embodiment of a bucket tooth for a bucket comprises a steel body comprising a bottom surface, a top surface opposite the bottom surface, and a tip; and a metallurgically bonded, wear-resistant coating formed on the bottom surface, top surface and tip of the body, the wear-resistant coating comprising a fused hard metal alloy comprising at least 60% by weight iron, cobalt, nickel or alloys thereof.

An exemplary embodiment of a bucket tooth assembly comprises at least one bucket tooth; at least one bucket tooth adapter, each bucket tooth adapter configured to be attached to a cutting edge of a bucket and to a bucket tooth; and at least one fastener, each fastener adapted to fasten a bucket tooth to a bucket tooth adapter.

An exemplary embodiment of a bucket tooth assembly comprises at least one bucket tooth comprising a steel body comprising a bottom surface, a top surface opposite the bottom surface, and a tip; and a metallurgically bonded, wear-resistant coating formed on the bottom surface, top surface and tip of the body, the wear-resistant coating comprising a fused hard metal alloy comprising at least 60% by weight iron, cobalt, nickel or alloys thereof. The bucket tooth assembly comprises at least one bucket tooth adapter, each bucket tooth adapter configured to be attached to a cutting edge of a bucket and to a bucket tooth; and at least one fastener, each fastener adapted to fasten a bucket tooth to a bucket tooth adapter.

An exemplary embodiment of a method of making a bucket tooth comprises forming a body including a top surface, a bottom surface and a tip; coating the top surface, bottom surface and tip with a slurry comprising a fusible, hard metal alloy with at least 60% by weight of iron, cobalt, nickel or alloys thereof in the form of a finely divided powder, polyvinyl alcohol, a suspension agent and a deflocculant; and forming a metallurgical bond between the top surface, bottom surface and tip and the coating slurry to form a wear-resistant coating.

DETAILED DESCRIPTION OF PREFERRED EMBODIMENTS

Bucket teeth for buckets of excavators, diggers and other related excavation, digging, construction and mining apparatus are provided. The bucket teeth have a protective wear-resistant coating on their outer surface. The coating has properties effective to provide protection to the bucket teeth against both wear and corrosion. Methods of making bucket teeth having such protective coatings are also provided.

Figure 1:
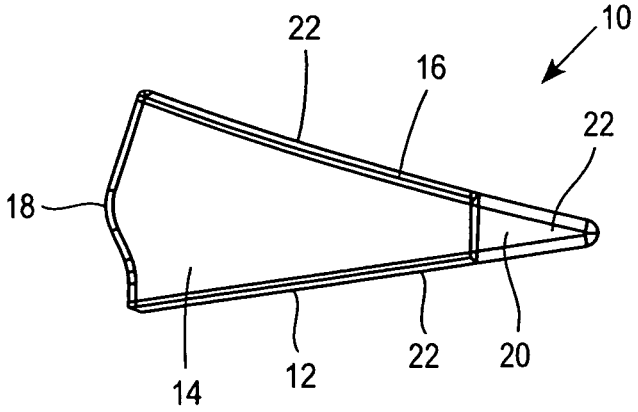
FIG. 1 shows a side view of an embodiment of a bucket tooth having a wear-resistant coating.
Figure 2:
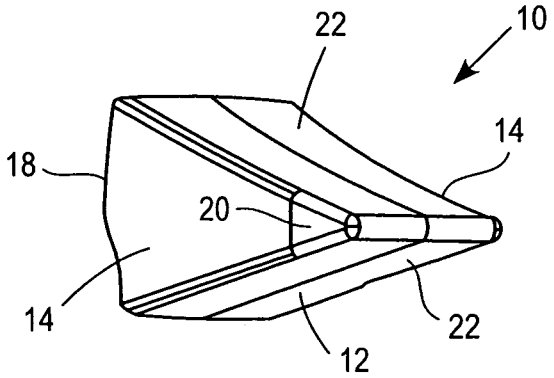
FIG. 2 shows another view of the bucket tooth of FIG. 1.
Figure 3:
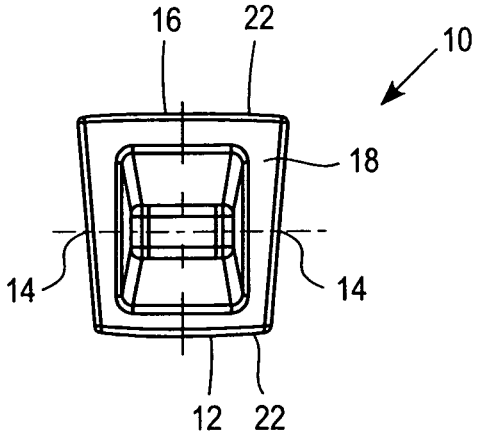
FIG. 3 shows a back view of the bucket tooth of FIG. 1.

FIGS. 1 to 3 depict an exemplary embodiment of a bucket tooth 10 for a bucket. As shown, the bucket tooth 10 includes a bottom surface 12, opposed side surfaces 14, a top surface 16, a rear face 18, and a tip 20. In the embodiment, the bottom surface 12 is substantially planar along its length from the rear face 18 to the front of tip 20, and the top surface 16 has a concave curvature. As shown in FIG. 3, the bucket tooth 10 is open at the rear face 18. The bucket tooth 10 can be for a bucket for a loader, for example.

In the embodiment, a protective, wear-resistant coating 22 is provided on the bottom surface 12, top surface 16 and tip 20 of the bucket tooth 10. The wear-resistant coating 22 is preferably formed on the entire bottom surface 12 of the bucket tooth 10 to provide wear protection to the entire bottom surface 12, as shown. The wear-resistant coating 22 can be provided on only a portion of the top surface 16. As shown, the wear-resistant coating 22 can cover the entire top surface 16 to provide wear protection to the entire top surface 16. The wear-resistant coating 22 preferably covers the entire tip 20 including on the bottom surface 12, top surface 16 and side surface 14. As shown, the wear-resistant coating 22 preferably also covers portions of the side surfaces 14 at the tip 20 of the bucket tooth 10. In other embodiments, the coating 22 can entirely cover the side surfaces 14.

Figure 4:
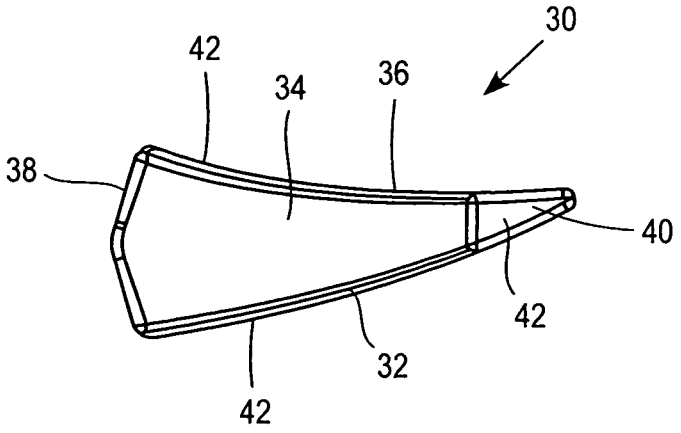
FIG. 4 shows a side view of another embodiment of a bucket tooth having a wear-resistant coating.
Figure 5:
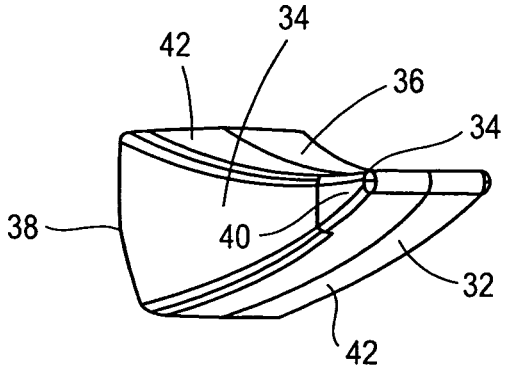
FIG. 5 shows another view of the bucket tooth of FIG. 4.
Figure 6:
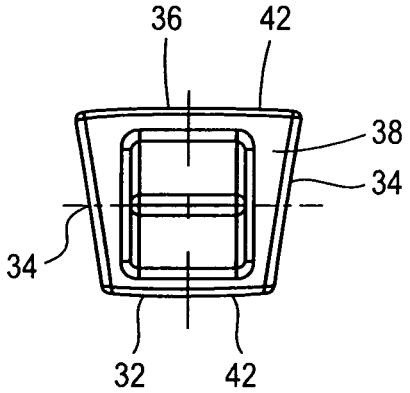
FIG. 6 shows a back view of the bucket tooth of FIG. 4.

FIGS. 4 to 6 depict another exemplary embodiment of a bucket tooth 30. As shown, the bucket tooth 30 includes a bottom surface 32, opposed side surfaces 34, a top surface 36, a rear face 38, and a tip 40. As shown, the bottom surface 32 has a convex curvature, and the top surface 36 has a desired concave curvature. The bucket tooth 30 can be for a bucket for a backhoe excavator, for example.

In the embodiment, a protective wear-resistant coating 42 is provided on the bottom surface 32, top surface 36 and tip 40 of the bucket tooth 30. The wear-resistant coating 42 is preferably provided on the entire bottom surface 32 of the bucket tooth 30, as shown. The wear-resistant coating 42 can be provided on only a portion of the top surface 36, or the wear-resistant coating 42 can cover the entire top surface 36, as shown. The wear-resistant coating 42 preferably covers the entire tip 40 including the bottom surface 32, top surface 36 and side surfaces 34. The wear-resistant coating 42 preferably also covers portions of the side surfaces 34 at the tip 40. In other embodiments, the wear-resistant coating can entirely cover the side surfaces 42. As shown in FIG. 6, the bucket tooth 30 is open at the rear face 38.

Figure 7:
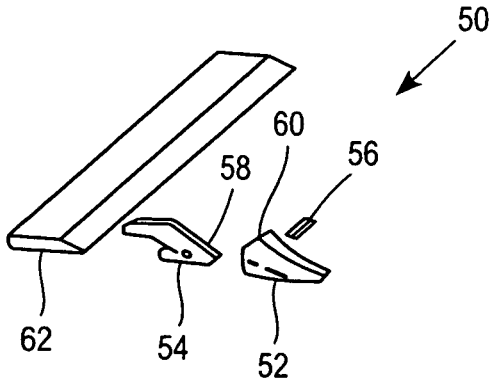
FIG. 7 shows an exemplary embodiment of a bucket tooth assembly.

FIG. 7 shows a bucket tooth assembly 50 including a bucket tooth 52. The bucket tooth 52 can have a configuration, such as the configuration of the bucket tooth 10 or the bucket tooth 30. The assembly 50 includes a bucket tooth adapter 54 and a fastener 56. The fastener 56 can be a pin or bolt, for example. The bucket tooth adapter 54 is configured such that a front portion 58 can be partially inserted into the bucket tooth 52 at the open rear face 60 of the bucket tooth 52, and fastened to the bucket tooth 52 with the fastener 56. The bucket tooth adapter 54 can be mounted to a cutting edge 62 of a bucket of an excavator, digger and other related excavation, digging, construction or mining apparatus, to secure the bucket tooth 52 to the bucket. Multiple bucket tooth assemblies 50 are typically mounted to the cutting edge 62 of the bucket along the length of the cutting edge.

The bucket tooth can be formed of any suitable steel material having desired toughness, strength and hardness properties for use in the bucket tooth. For example, the steel can be a medium carbon steel, a hardened steel, or other steel. The steel can be cast or forged, for example.

The alloy composition for the wear-resistant coating is chosen such that the fused coating has a hardness that is sufficiently higher than that of materials that the bucket tooth is typically subjected to during service, e.g., dry or wet sand, gravel, rock and the like. An alloy powder can be used that forms a coating having a hardness of about 800 HV to about 1100 HV.

Commonly owned U.S. Pat. No. 5,879,743, the entire contents of which are incorporated herein by reference, discloses a suitable wear-resistant alloy that can be used as the coating material for the bucket teeth. Additionally, slurry and coating techniques incorporating the slurry that are suitable for bucket teeth are disclosed. For example, the fusible hard metal alloy in exemplary embodiments contains at least 60% of a transition metal of Group VIII of the Periodic Table, such as iron, cobalt, or nickel. However, the hard metal alloy may be based on other metals, so long as the alloy has suitable physical properties and would form a metallurgical bond with the bucket tooth. Minor components (about 0.1 to about 20 wt. %) typically are boron, carbon, chromium, iron (in nickel and cobalt-based alloys), manganese, nickel (in iron and cobalt-based alloys), silicon, tungsten, molybdenum, one or more carbide forming elements, or combinations thereof. Elements in trace amounts (less than about 0.1 wt. %), such as sulfur, may be present as de minimis contaminants. In exemplary embodiments, the alloy has a Vickers Hardness (HV) of at least about 950 HV to about 1250 HV. The hard metal alloy has a fusion temperature that is lower than the melting point of the metal that is to be coated, e.g., about 1110° C. or less, and is preferably, between about 900° C. and about 1200° C., preferably up to about 1100° C.

Prior to applying the coating on the bucket tooth, the portion of the bucket tooth that is to be coated is preferably subjected to a preliminary cleaning step to remove surface corrosion and other undesired substances to ensure good bonding of the coating to bucket tooth outer surface. For example, the bucket tooth can be subjected to abrading, e.g., wheel abrading, to remove undesired substances from bucket tooth outer surface before coating.

The surface of the bucket tooth on which the wear-resistant coating is applied typically has a carbon content of about 0.35 wt. % or less, such as about 0.3 wt. %, 0.25 wt. %, 0.2 wt. %, 0.15 wt. %, or less. In an exemplary embodiment, the surface of the bucket tooth that is coated can be decarburized using process conditions effective to reduce the carbon content in the surface region of the bucket tooth to a desired maximum level, such as about 0.35 wt. %, 0.3 wt. %, 0.25 wt. %, 0.2 wt. % or 0.15 wt. %, to a desired depth below the coated surface. The surface region can be subjected to decarburization such that the subsequent metallurgical bond only occurs with non-carburized metal. For example, decarburization of the carburized layer can occur to a depth of about 0.002 to about 0.003 inch (50-75 microns) to a carbon level of less than about 0.35 wt. %, such as less than about 0.3 wt. %, 0.25 wt. %, 0.2 wt. %, 0.15 wt. % or less. In an exemplary embodiment, the carburized depth can be up to about 0.010 inches and the decarburization can occur to a depth of up to about 0.015 inches.

The surface of the bucket tooth to be coated can be uncarburized either by a heat treatment method, e.g., decarburized, or by removal of carburized material by, e.g., machining, cutting, lathing, grinding, and/or polishing, to expose a non-carburized layer before applying the hard metal alloy to the bucket tooth. A metallurgical bond is then formed between the selected portion of the surface of the bucket tooth and the coated unfused slurry by fusing the hard metal alloy, thereby forming the wear-resistant coating.

Prior to applying the wear-resistant coating, the bucket tooth optionally can be subjected to a degassing process in a vacuum furnace.

Prior to applying the wear-resistant coating, e.g., after performing the abrading or degassing step, the bucket tooth can then be subjected to a peening operation, such as shot blasting or the like, to achieve the desired surface condition of the bucket tooth.

A slurry of a hard metal alloy is then coated on the desired portion of the outer surface of the bucket tooth and a metallurgical bond is formed between the non-carburized layer and the coated unfused slurry by fusing the hard metal alloy, thereby forming the wear-resistant coating. The slurry is aqueous-based and can be formed of polyvinyl alcohol (PVA) and a fusible, hard metal alloy in the form of a finely divided powder. Examples of a suitable slurry are disclosed in U.S. Pat. No. 5,879,743. As discussed herein and disclosed in the '743 patent, the hard metal alloy can be a transition metal of Group VIII of the Periodic Table, such as iron, cobalt, nickel, or alloys thereof. In an exemplary embodiment, the hard metal alloy is a finely divided powder having a sufficiently small particle size to form a uniform slurry. Typical particle sizes can range from about 90 mesh to about 400 mesh, and can be finer than 400 mesh. Preferably, the average particle size is finer than about 115 mesh and, most preferably, finer than about 200 mesh. The powder can be a mixture of powders of different particle sizes. Also, one or more suspension agents and one or more deflocculants can optionally be added to the slurry.

The slurry is prepared by thoroughly mixing the powdered, hard metal alloy with a polyvinyl alcohol binder solution to give the desired alloy to binder solution weight ratio, as described in the '743 patent. Other additives to the slurry can include suspension agents and deflocculants.

The slurry can be applied to the outer surface of the bucket teeth by any suitable coating technique. For example, the slurry can be spray coated, spun cast, dipped, poured, or spread, e.g., applied with a brush or a doctor blade.

In one exemplary embodiment, a substantially uniform aqueous slurry of polyvinyl alcohol and a fusible, hard metal alloy in the form of a finely divided powder is formed and coated on the desired portion of the surface of the bucket tooth. The aqueous slurry is then dried by heating at a suitable temperature to leave a solid layer of the fusible, hard metal alloy in a polyvinyl alcohol matrix on the metal surface. The steps of coating the metal surface and drying the slurry to leave a solid layer may be repeated one or more times, such as 1, 2, 3, 4, 5 or more times, to build up a thicker coating of the slurry material.

In another exemplary embodiment, the metal surface is coated with an aqueous polyvinyl alcohol solution, and a substantially uniform layer of a fusible, hard metal alloy in the form of a finely divided powder is distributed onto the coating of the polyvinyl alcohol solution before the polyvinyl alcohol solution dries. The steps of coating the metal surface, distributing the fusible hard metal alloy, and drying the mixture of polyvinyl alcohol, binder and alloy powder to leave a solid layer may be repeated one or more times to build up a thicker coating of the slurry material. The required thickness can be built by repeated spraying with intervening drying cycles. The drying may be done at about 80° C. to about 100° C. in, for example, a forced circulation air oven.

Dipping, pouring, and brushing is useful for forming relatively thick coatings, e.g., greater than 1 mm, in a short period of time (although repeated spaying can be used to build up a thick layer over a longer period of time). For these procedures, preferably the ratio of hard metal alloy to polyvinyl alcohol solution is in the range of about 4:1 to about 8:1 and the concentration of polyvinyl alcohol solution is about 1% to about 15% polyvinyl alcohol by weight. For example, 0500/0250 and 0600/0250 or similar slurries are suitable for this procedure. The representation xxxx/yyyy indicates the slurry parameters, where xxxx=weight ratio of powdered alloy to polyvinyl alcohol and yyyy=weight percent of polyvinyl alcohol present in the aqueous solution as a binder. A decimal point is implicit after the first two digits in the representation. Thus, 0500 represents 5.0. Thick slurry compositions, i.e., a high ratio of alloy to polyvinyl alcohol solution, can be applied as a squeezable paste, or can be rolled into tapes for bonding to the metal surface. For these procedures, preferably the ratio of alloy to polyvinyl alcohol solution is in the range of about 8:1 to about 15:1 by weight and the concentration of polyvinyl alcohol solution is about 2% to about 15% polyvinyl alcohol by weight. In the above procedures, special additives can function as dispersants, suspending agents, and plasticizers.

The thickness of the coated, unfused slurry can be adjusted by a shrinkage factor to result in a desired final thickness after metallurgical bonding. For example, the slurry described herein typically has a shrinkage factor of about 0.55±0.05. Accordingly, the thickness of the slurry before fusing can be adjusted according to the shrinkage factor to result in a desired final thickness of the wear-resistant coating, e.g., an unfused slurry layer of about 1.5 to about 2.0 times the final thickness can be used. The coating can be applied to any thickness desired unlike many other coatings or platings. This aspect provides versatility to apply thicker coatings to correspondingly increase the joint life.

Bonding is the step of forming a metallurgical bond between the dried slurry coating and the bucket tooth, i.e., a selected portion of the bucket tooth that has not previously been carburized, or a bucket tooth that has been decarburized to the desired carbon level, or has had a portion of the carburized metal removed to expose a non-carburized surface. For example, the metal surface coated with the layer of fusible, hard metal alloy in the polyvinyl alcohol matrix or coated with the aqueous polyvinyl alcohol solution with the layer of fusible, hard metal alloy can be heated to the fusing temperature of the hard metal alloy under a protective atmosphere until the hard metal alloy has fused onto the metal surface. Heating occurs in a controlled atmosphere, i.e., an inert or reducing atmosphere. For example, a partial pressure of about 100 to about 500 μm of He or Ar in a vacuum furnace or a slight positive pressure of about a few inches of water above atmospheric pressure of Ar, He or $H_2$ in a belt furnace are suitable for use during fusing. Subsequently, the metal surface with the fused hardfacing is cooled to ambient temperature.

In one example of the bonding process, the bucket tooth is heated to a temperature of about 1050° C. to about 1110° C. The heating can be performed in a belt type conveyor furnace at a hydrogen pressure slightly above atmospheric, and the bucket tooth can be held at the desired fusing temperature for about 2 minutes to about 5 minutes and then cooled After metallurgically bonding the slurry to the bucket tooth to form the wear-resistant coating, which can comprise one or more layers, the bucket tooth can be hardened by a thermal treatment that is effective to increase hardness as compared to the uncarburized metal. The coating technology permits the parts to be heat treated after the coating is fused without detriment to the coating, or the bond to the substrate.

For example, a slurry coated bucket tooth can optionally then be through hardened by quenching and tempered to the required bulk hardness for improving the mechanical strength of the bucket tooth. The body below the coated surface can be hardened, such as by induction hardening, to increase the substrate hardness to HRC 50-60, which is higher than the bulk hardness of the quenched and tempered steel. This hardening further increases the wear life of the bucket tooth. Thus, the wear life of a coated and heat treated (by through-hardening and induction hardening) bucket tooth can be the sum of the wear life of the slurry coating and the wear life of the induction hardened steel substrate below the coating. Typically, a coating thickness of not more than 1-2 mm is sufficient to provide the desired wear/corrosion protection to the bucket tooth.

Because the coating is metallurgically bonded to the body of the bucket tooth there is minimal or no risk of debonding of coating even under the effect of high contact loads, which are quite common in heavy equipment operation.

For example, when the bucket tooth is formed of a medium carbon steel, the bucket tooth can be quenched to harden the steel, such as by heating the bucket tooth to a temperature of about 840° C. for a 1045 steel and soaking at the quenching temperature, in this case 840° C., for an effective time period, and quenching in a suitable quenching medium, preferably a liquid. The quenched bucket tooth can be tempered at the desired temperature of between 250° C. and 500° C. to achieve the required bulk hardness for improving the mechanical strength of the bucket tooth and the wear resistance of the body of the bucket tooth. The substrate below the coated surface may optionally again be hardened by induction hardening, if desired, to increase the substrate hardness to approximately HRC 50-55 or more. This higher hardness of the coating substrate adds further to the wear life of the bucket tooth.

Further, the wear-resistant coating preferably contains substantially no inclusions, such that the wear-resistant coating is uniformly dense (i.e., substantially non-porous) and durable.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A bucket tooth for a bucket, comprising:

a steel body comprising a bottom surface, a top surface opposite the bottom surface, and a tip disposed between the bottom surface and the top surface, wherein the top surface and the bottom surface converge toward the tip; and a metallurgically bonded, wear-resistant coating formed on the bottom surface, top surface and tip of the body, the wear-resistant coating comprising a fused hard metal alloy comprising at least 60% by weight iron, cobalt, nickel or alloys thereof wherein the wear-resistant coating is formed on the entire bottom surface, wherein the bottom surface is substantially planar and the top surface is concave.

2. The bucket tooth of claim 1, wherein the steel is a hardened steel.

3. The bucket tooth of claim 1, wherein the steel is a medium carbon steel.

4. The bucket tooth of claim 1, wherein the body comprises opposed side surfaces, and the wear-resistant coating is on at least a portion of each of the side surfaces.

5. The bucket tooth of claim 1, wherein the wear-resistant coating has a Vickers hardness greater than 950 HV, and a thickness of about 1 mm to about 5 mm.

6. The bucket tooth of claim 1, wherein at least the tip comprises a surface hardened region extending inwardly from the coating.

7. The bucket tooth of claim 6, wherein the surface hardened region is an induction hardened region.

8. The bucket tooth of claim 1, wherein the body is a casting.

9. The bucket tooth of claim 1, wherein the body is a forging.

10. The bucket tooth of claim 1, wherein the body comprises a decarburized surface region having a carbon content of less than about 0.35 wt. % on which the coating is disposed.

11. A method of making a bucket tooth, comprising:

forming a body including a top surface, a bottom surface and a tip disposed between the bottom surface and the top surface, wherein the top surface and the bottom surface converge toward the tip;

coating the top surface, bottom surface and tip with a slurry comprising a fusible, hard metal alloy with at least 60% by weight of iron, cobalt, nickel or alloys thereof in the form of a finely divided powder, polyvinyl alcohol, a suspension agent and a deflocculant; and forming a metallurgical bond between the top surface, bottom surface and tip and the coating slurry to form a wear-resistant coating wherein the wear-resistant coating is formed on the entire bottom surface, wherein the bottom surface is substantially planar and the top surface is concave.

12. The method of claim 11, wherein the forming of a metallurgical bond comprises drying the coated slurry, heating the coated body to a fusion temperature of the fusible, hard metal alloy in a controlled atmosphere of at least one inert gas or reducing atmosphere excluding nitrogen, and cooling the coated body to ambient temperature.

13. The method of claim 11, further comprising shot blasting the top surface, bottom surface and tip prior to applying the coating thereon.

14. The method of claim 11, wherein the steel is a hardened steel.

15. The method of claim 11, wherein the steel is a medium carbon steel.

16. The method of claim 11, wherein the body comprises opposed side surfaces, and the wear-resistant coating is applied on at least a portion of each of the side surfaces.

17. The method of claim 11, wherein the wear-resistant coating has (i) a Vickers hardness greater than 950 HV and (ii) a thickness of about 1 mm to about 5 mm.

18. The method of claim 11, further comprising, prior to the coating, decarburizing a surface region of the bucket tooth extending inwardly from the top surface, bottom surface and tip, to reduce the carbon level of the surface region to a carbon content of less than about 0.35 wt. %.

19. The method of claim 11, comprising forming a surface hardened region extending inwardly from the coating by induction hardening.

20. The method of claim 11, further comprising hardening the coated bucket tooth by quenching and tempering.

21. A bucket tooth for a bucket, comprising:

a steel body comprising a bottom surface, a top surface opposite the bottom surface, and a tip disposed between the bottom surface and the top surface, wherein the top surface and the bottom surface converge toward the tip; and a metallurgically bonded, wear-resistant coating formed on the bottom surface, top surface and tip of the body, the wear-resistant coating comprising a fused hard metal alloy comprising at least 60% by weight iron, cobalt, nickel or alloys thereof wherein the wear-resistant coating is formed on the entire bottom surface, wherein the bottom surface is convex and the top surface is concave.

22. A method of making a bucket tooth, comprising:

forming a body including a top surface, a bottom surface and a tip disposed between the bottom surface and the top surface, wherein the top surface and the bottom surface converge toward the tip;

coating the top surface, bottom surface and tip with a slurry comprising a fusible, hard metal alloy with at least 60% by weight of iron, cobalt, nickel or alloys thereof in the form of a finely divided powder, polyvinyl alcohol, a suspension agent and a deflocculant; and forming a metallurgical bond between the top surface, bottom surface and tip and the coating slurry to form a wear-resistant coating wherein the wear-resistant coating is formed on the entire bottom surface, wherein the bottom surface is convex and the top surface is concave.

* * * * *